US006442834B1

(12) United States Patent
Takahashi

(10) Patent No.: US 6,442,834 B1
(45) Date of Patent: Sep. 3, 2002

(54) METHOD OF MANUFACTURE SUBSTRATE-USE TERMINALS

(75) Inventor: Toshiharu Takahashi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/475,266

(22) Filed: Dec. 30, 1999

(30) Foreign Application Priority Data

Feb. 19, 1999 (JP) ..... 11-041929

(51) Int. Cl.[7] ..... H01R 43/16

(52) U.S. Cl. ..... 29/874; 29/882; 29/884; 29/33 M; 439/84; 439/751

(58) Field of Search ..... 29/874, 882, 876, 29/884, 33 M, 883, 871, 868; 439/82, 84, 758, 751

(56) References Cited

U.S. PATENT DOCUMENTS 2,610,390 A * 9/1952 Locke ..... 29/155.55
3,786,558 A * 1/1974 McCarthy ..... 29/630
4,206,964 A * 6/1980 Olsson ..... 339/221 M
4,739,551 A * 4/1988 Bowsky et al. ..... 29/882
4,763,408 A * 8/1988 Heisey et al. ..... 29/874
4,774,763 A * 10/1988 Palecek et al. ..... 29/874
4,857,019 A * 8/1989 Brubaker et al. ..... 439/751
5,259,111 A * 11/1993 Watanable ..... 29/885
5,735,042 A * 4/1998 Takano et al. ..... 29/784
5,915,759 A * 6/1999 Logerot et al. ..... 29/874

FOREIGN PATENT DOCUMENTS

JP 5-36458 A * 2/1993 ..... 29/874
JP 2000-30834 A * 1/2000

* cited by examiner

*Primary Examiner*—Peter Vo
*Assistant Examiner*—Minh Trinh
(74) *Attorney, Agent, or Firm*—Sughrue Mion, PLLC

(57) ABSTRACT

In the method of manufacturing substrate-use terminals in accordance with the present invention, a rectangular wire 10 is first subjected to cylindrical shaping to form a substrate-side terminal portion 22. Next, a loss portion 14, which is a connecting portion between a tip portion 22*a* of the substrate-side terminal portion 22 and a tip portion 21*a* of a connector-side terminal portion 21 and is not used as a portion of a substrate-use terminal 20 after being cut off, is subjected to cutting so as to provide primary machining for the tip portions 21*a* and 22*a*. Subsequently, the connector-side terminal portion 21 and the substrate-side terminal portion 22 are subjected to tip crushing to provide secondary machining for the tip portions 21*a* and 22*a*. Next, a retaining section 23 for engagement in a connector housing is formed, and the loss portion 14 is finally cut off to form the single-unit substrate-use terminal 20.

6 Claims, 6 Drawing Sheets

(B-B)

(C-C)

METHOD OF MANUFACTURE SUBSTRATE-USE TERMINALS

BACKGROUND OF INVENTION

1. Field of Invention

The present invention relates to a method of manufacturing substrate-use terminals for relatively small electric current, which are used in electrical connection of various equipment mounted in an automobile or the like. More particularly, the present invention relates to a method of manufacturing substrate-use terminals in which substrate-use terminals each have at one end a connector-side terminal portion for connection to a connector and at the other end a substrate-side terminal portion for connection to a substrate. The substrate-use terminals are manufactured by using a continuous rectangular wire as a base material.

2. Related Art

As a conventional method of manufacturing substrate-use terminals, a method is known in which substrate-use terminals are manufactured by using a continuous rectangular wire as a base material by subjecting the continuous rectangular wire to required shaping and by cutting off the rectangular wire into units for forming the substrate-use terminals after the shaping.

As shown in FIGS. 4 and 5, in a substrate-use terminal 30, a connector-side terminal portion 31, which is connected to a connector housing 40 (see FIG. 6), and a substrate-side terminal portion 32, which is connected to an unillustrated substrate (PCB), are formed at its one end and at its other end, respectively, by shaping before cutting off. It should be noted that FIG. 4(*a*) is a side elevational view; FIG. 4(*b*) is a plan view; FIG. 4(*c*) is a cross-sectional view taken in the direction of arrow A; FIG. 5(*a*) is a side elevational view; and FIG. 5(*b*) is a plan view.

At the time of the shaping of the substrate-use terminal, it is generally necessary to set the thickness $t_3$ of the tip of the connector-side terminal portion 31 to 0.3 mm or less so as not to cause a spring portion 42 of a female terminal 41 to undergo deformation (i.e., not to be subjected to an overstressing impingement) during the insertion of the connector-side terminal portion 31 into the connector housing 40, shown in FIG. 6. The overstressing impingement causes plastic deformation of the spring portion 42 as a stress exceeding an allowable limit is applied thereto when the tip of the connector-side terminal portion 31 of the substrate-use terminal 30 on the male terminal side, when inserted, strikes against the spring portion 42 of the female terminal 41 of the connector housing 40.

Meanwhile, in the case where the substrate-use terminals 30 are manufactured by using a continuous rectangular wire 33 as a base material, the machined sectional area in the shaping (tip crushing) of the connector-side terminal portion 31 and the substrate-side terminal portion 32 generally needs to be set to 35% or less of the sectional area of the base material. If this machined sectional area is set to more than 35% of the sectional area of the base material, there is a possibility that the rectangular wire 33 undergoes fracture in the manufacturing process, and if it fractures, it becomes impossible to feed the rectangular wire 33.

However, with the above-described conventional method of manufacturing the substrate-use terminals 30, end portions of the respective units of the rectangular wire 33, which respectively serve as the single-unit substrate-use terminals 30 after being cut off, i.e., the tip portions of the connector-side terminal portion 31 and the substrate-side terminal portion 32 of the substrate-use terminals 30, are connected in chain form before being cut off.

Accordingly, the respective tip portions are subjected to shaping in the identical process. For this reason, the connector-side terminal portion 31 and the substrate-side terminal portion 32 of the substrate-use terminal 30 can be machined only into the same tip shape. Namely, as shown in FIG. 5, the thickness $t_3$ of the tip of the connector-side terminal portion 31 of the substrate-use terminal 30 cannot be set to 0.5 mm or less, and the thickness $t_4$ of the tip of the substrate-side terminal portion 32 also becomes the same thickness ($t_4 = t_3$). With respect to the width $w_3$ of the tip of the connector-side terminal portion 31, the width $w_4$ of the tip of the substrate-side terminal portion 32 also becomes the same width ($w_4 = w_3$).

Further, there has been a problem in that it is impossible to implement the process of manufacturing the substrate-use terminals 30 whereby the machined sectional area of the rectangular wire 33, i.e., the base material, is set to 35% or less of the sectional area of the base material in the step of shaping the connector-side terminal portion 31 and the substrate-side terminal portion 32.

SUMMARY OF INVENTION

The object of the present invention is to provide a method of manufacturing substrate-use terminals which makes it possible to set the thickness of the tip of the connector-side terminal portion of the substrate-use terminal to 0.3 mm or less, and to set the machined sectional area of the rectangular wire, i.e., the base material, to 35% or less of the sectional area of the base material during the shaping of the connector-side terminal portion and the substrate-side terminal portion.

The above problems pertaining to the present invention can be overcome by a method of manufacturing substrate-use terminals in which substrate-use terminals each having at one end thereof a connector-side terminal portion for connection to a connector and at another end thereof a substrate-side terminal portion for connection to a substrate are manufactured as a continuous rectangular wire is subjected to shaping and cutting off after the shaping, provided in that a loss portion which is not used as a portion of the substrate-use terminal after being cut off is provided between units of the rectangular wire which are used as the substrate-use terminals by being cut off, when the rectangular wire is subjected to the shaping.

In addition, in the above-described method of manufacturing substrate-use terminals, respective tip portions of the connector-side terminal portion and the substrate-side terminal portion which are connected to both ends of the loss portion may preferably be respectively machined into desired different tip shapes.

In the method of manufacturing substrate-use terminals in the above-described arrangement, the loss portion which is not used as a portion of the substrate-use terminal after being cut off is provided between units of the rectangular wire which are used as the substrate-use terminals by being cut off, when the rectangular wire is subjected to the shaping, and the respective tip portions of the connector-side terminal portion and the substrate-side terminal portion which are connected to both ends of the loss portion are respectively machined into desired different tip shapes.

Accordingly, since the loss portion is provided, the respective tip portions of the connector-side terminal portion and the substrate-side terminal portion can be subjected to cutting prior to the tip crushing of the substrate-use terminal in the manufacturing process, and the respective tip portions can be machined into desired different tip shapes. Accordingly, the thickness of the tip portion of the connector-side terminal portion can be set to 0.3 mm or less, and the machined sectional area of the rectangular wire, i.e., the base material, can be controlled to 35% or less of the sectional area of the base material. Thus, it is possible to reliably prevent a situation in which spring portions of mating female terminals become deformed, or the rectangular wire becomes fractured during the manufacturing process.

In addition, the above problems pertaining to the present invention can be overcome by a method of manufacturing substrate-use terminals in which substrate-use terminals each having at one end thereof a connector-side terminal portion for connection to a connector and at another end thereof a substrate-side terminal portion for connection to a substrate are manufactured as a continuous rectangular wire is subjected to shaping and cutting off after the shaping, comprising:

a first step of subjecting the rectangular wire to cylindrical-shaping to form the substrate-side terminal portion; a second step of subjecting a loss portion, which is a connecting portion between a tip portion of the substrate-side terminal portion and a tip portion of the connector-side terminal portion, to cutting so as to provide primary machining for the tip portions; a third step of executing tip profiling to provide secondary machining for the tip portions; a fourth step of forming a retaining section for engagement in a connector housing; and a fifth step of cutting off the loss portion to form a single-unit substrate-use terminal.

In the method of manufacturing substrate-use terminals in the above-described arrangement, since the loss portion is provided, the tip portion of the connector-side terminal portion and the tip portion of the substrate-side terminal portion can be subjected to cutting prior to the third step of providing tip crushing.

Accordingly, the respective tip portions of the connector-side terminal portion and the substrate-side terminal portion can be machined into desired different tip shapes, and the thickness of the tip portion of the connector-side terminal portion can be set to 0.3 mm or less, and the machined sectional area of the rectangular wire, i.e., the base material, can be controlled to 35% or less of the sectional area of the base material. Thus, it is possible to reliably prevent a situation in which spring portions of mating female terminals become deformed, or the rectangular wire becomes fractured during the manufacturing process.

DETAILED DESCRIPTION OF PREFERRED EMBODIMENTS

Figure 1A:
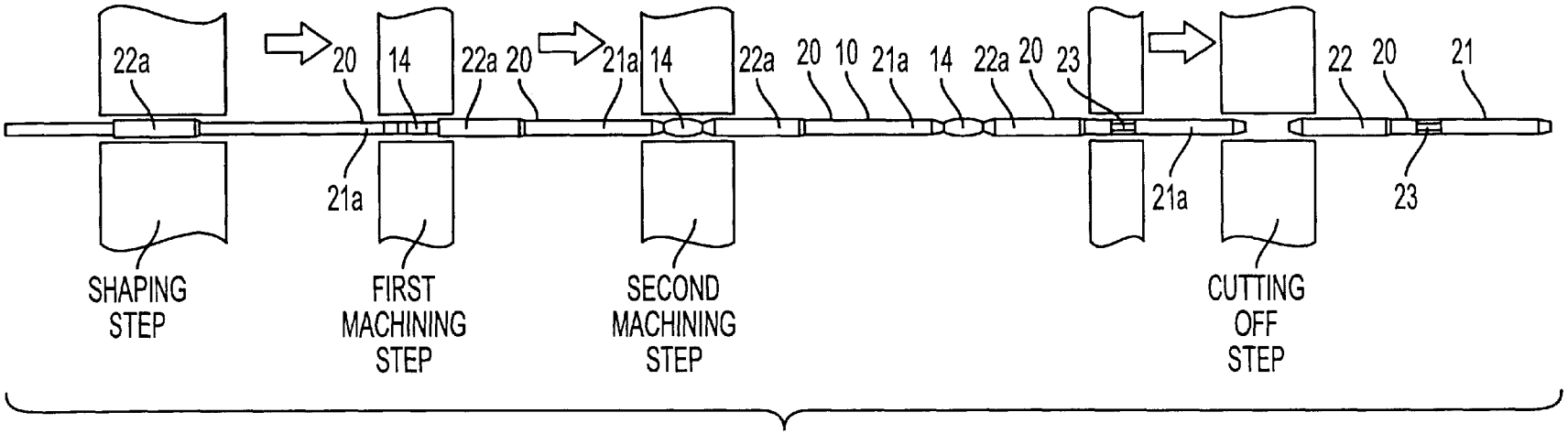
FIGS. 1(*a*) and (*b*) schematic explanatory diagrams illustrating a manufacturing process to which a method of manufacturing substrate-use terminals in accordance with an embodiment of the present invention is applied.
Figure 1B:
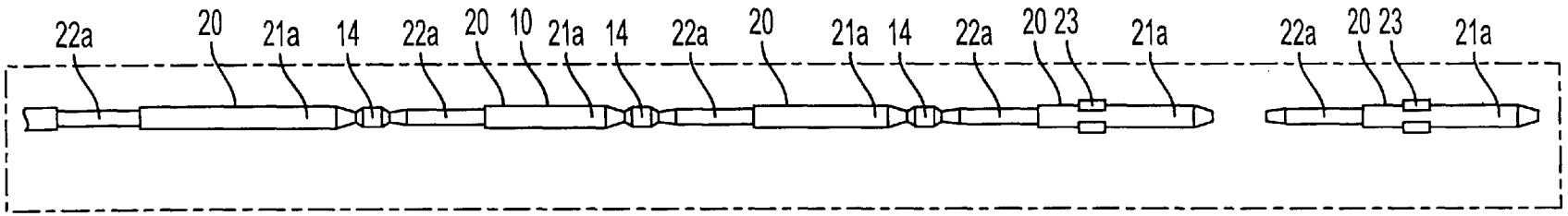
Figure 2:
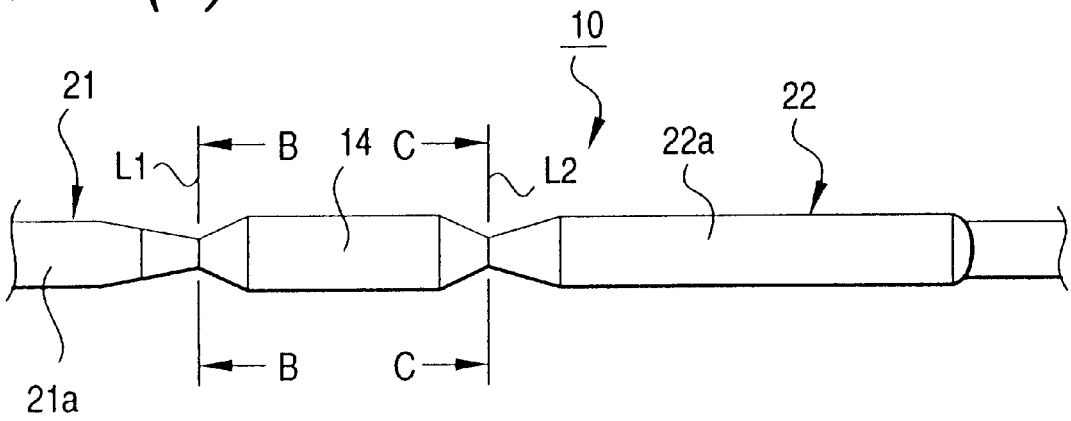
FIGS. 2(*a*) to (*d*) are enlarged views of essential portions of the substrate-use terminal, shown in FIG. 1, before being cut off.
Figure 2:
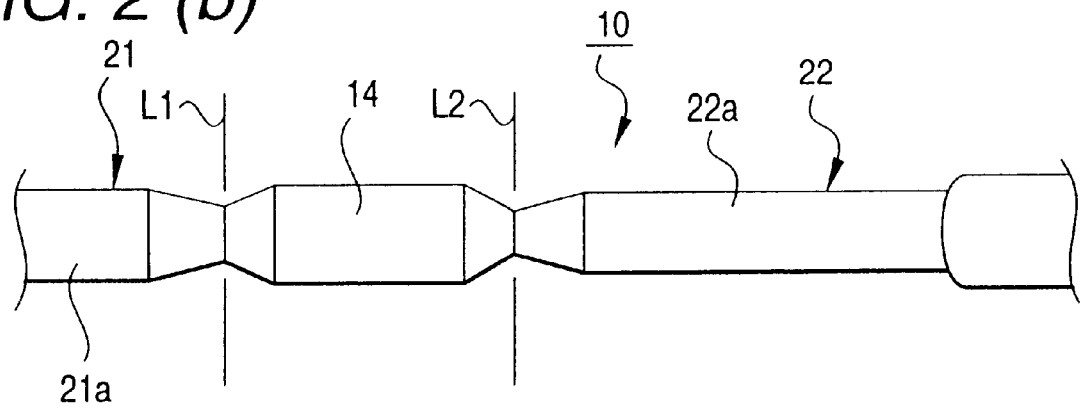
Figure 2:
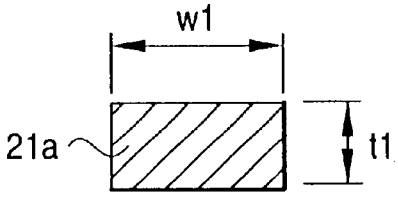
Figure 2:
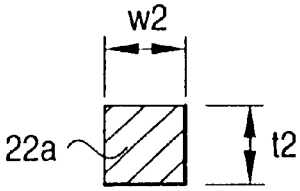
Figure 3:
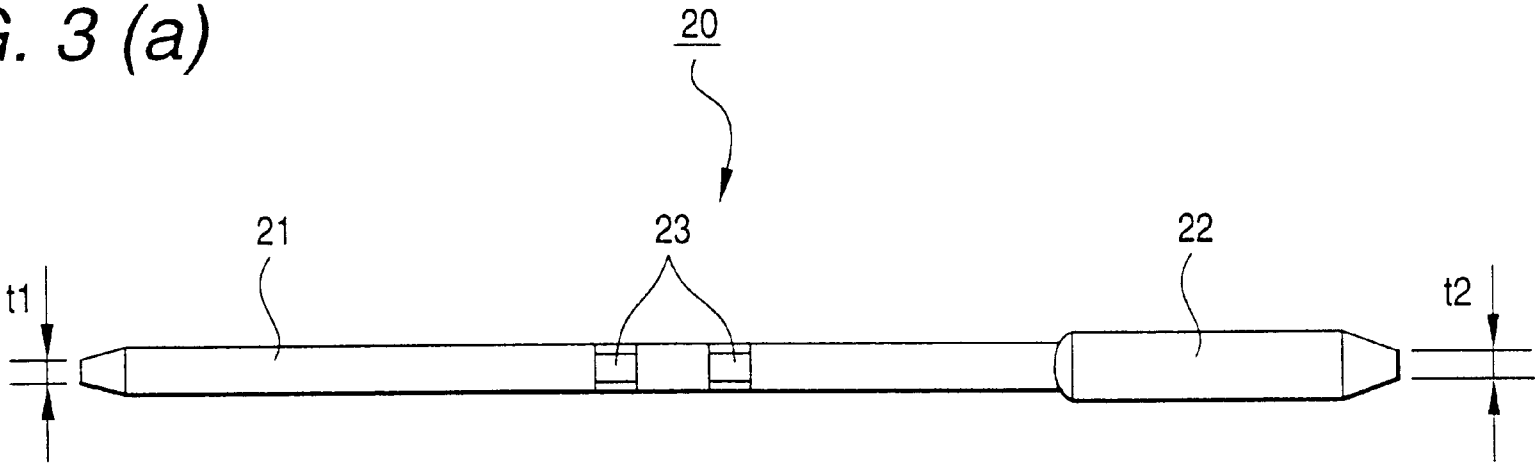
FIGS. 3(*a*) and (*b*) are explanatory diagrams illustrating the substrate-use terminal, shown in FIG. 1, after being cut off.
Figure 3:
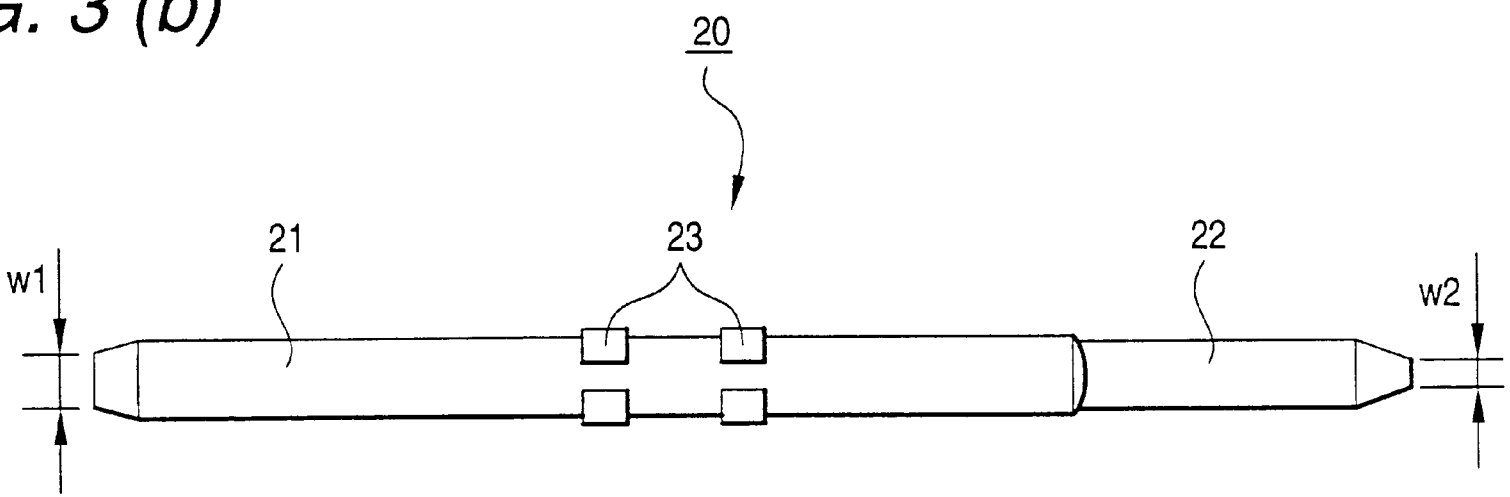
Figure 4A:
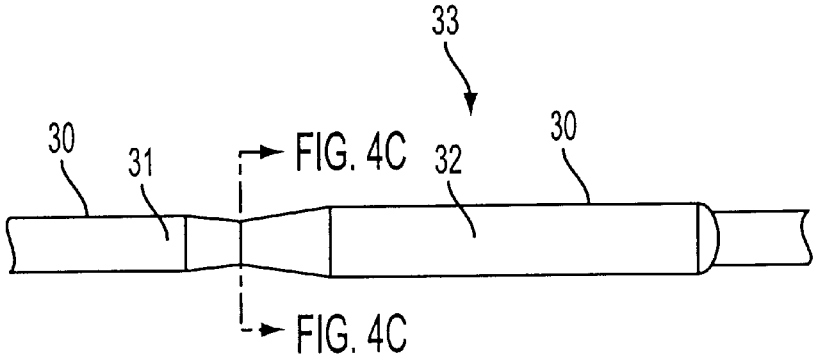
FIG. 4A (PRIOR ART)
FIGS. 4(*a*) to (*c*) enlarged views of essential portions of the substrate-use terminal before being cut off, illustrating a conventional method of manufacturing substrate-use terminals.
Figure 4B:
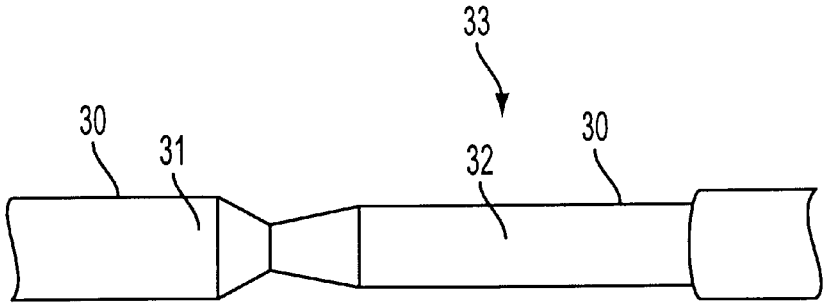
FIG. 4B (PRIOR ART)
Figure 4C:
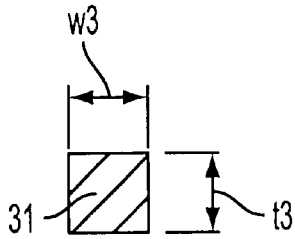
FIG. 4C (PRIOR ART)
Figure 5A:
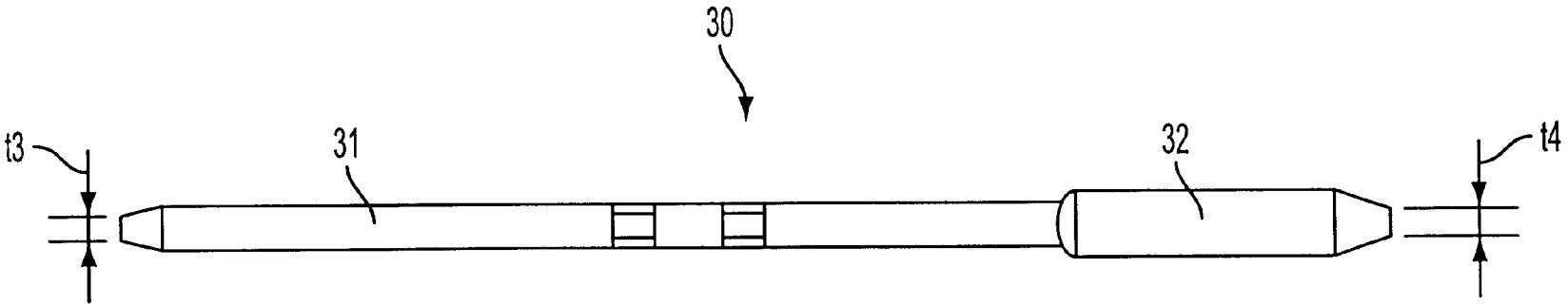
FIG. 5A (PRIOR ART)
FIGS. 5(*a*) to (*b*) are explanatory diagrams illustrating the substrate-use terminal, shown in FIG. 4, after being cut off.
Figure 5B:
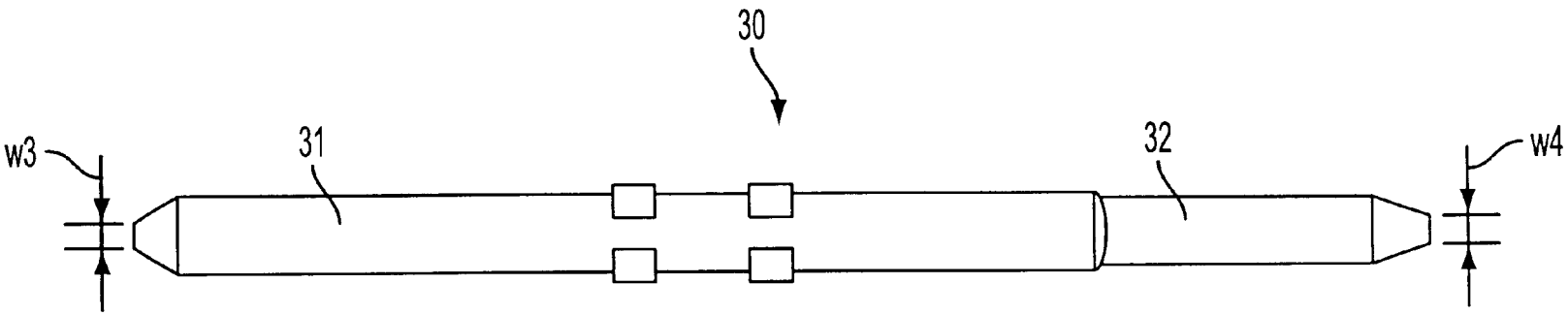
FIG. 5B (PRIOR ART)
Figure 6A:
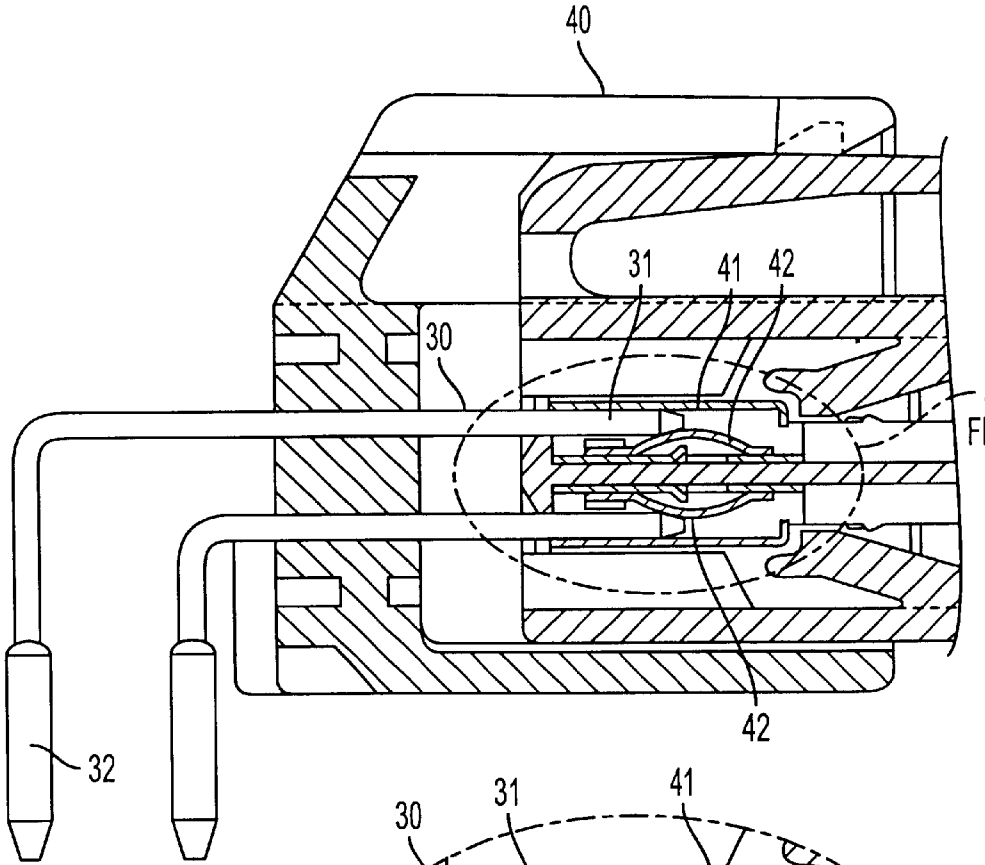
FIG. 6A (PRIOR ART)
FIG. 6 is a partial cross-sectional view illustrating a state in which the substrate-use terminals shown in FIG. 5 are inserted in a connector.
Figure 6B:
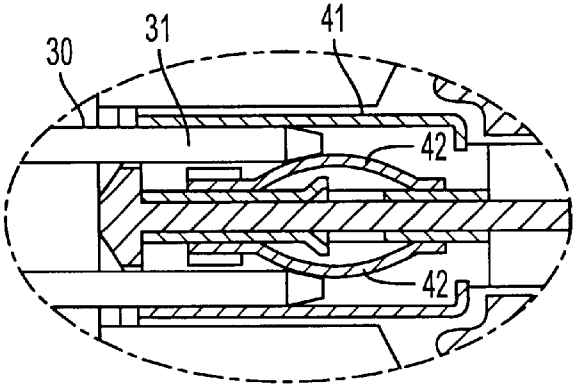
FIG. 6B (PRIOR ART)

Referring now to FIGS. 1 to 3, a description will be given of an embodiment of the method of manufacturing substrate-use terminals in accordance with the present invention. FIG. 1 is a schematic explanatory diagram illustrating the manufacturing process of the method of manufacturing substrate-use terminals in accordance with the present invention, in which the part (a) is a schematic side elevational view, and the part (b) is a schematic plan view. FIG. 2 is an enlarged view of essential portions of the substrate-use terminal shown in FIG. 1, in which the part (a) is a side elevational view, the part (b) is a plan view, the part (c) is a cross-sectional view taken in the direction of arrow B, and the part (d) is a cross-sectional view taken in the direction of arrow C. FIG. 3 is a enlarged view of the substrate-use terminal shown in FIG. 1, in which the part (a) is a side elevational view, and the part (b) is a plan view.

As shown in FIGS. 1 to 3, a substrate-use terminal 20 in this embodiment has at one end a connector-side terminal portion 21 which is made to project into a connector housing and is connected to a mating connector, and at the other end a substrate-side terminal portion 22 which is connected to a printed circuit board (PCB). In addition, the substrate-use terminal 20 has a retaining section 23 located between the terminal portions 21 and 22 and retained in the connector housing, and the substrate-use terminals 20 are manufactured as a continuous rectangular wire 10 is subjected to shaping and cutting off after the shaping.

Namely, as shown in FIG. 1(*a*), in the process of manufacturing the substrate-use terminals, the rectangular wire 10 is subjected to cylindrical shaping to form the substrate-side terminal portion 22(first step). Next, a loss portion 14, which is a connecting portion between a tip portion 22*a* of the substrate-side terminal portion 22 and a tip portion 21*a* of the connector-side terminal portion 21 and is not used as a portion of the substrate-use terminal 20 after being cut off, is subjected to cutting (padding cut) so as to provide primary machining for the tip portions 21*a* and 22*a* (second step). Subsequently, tip profiling (tip crushing) of the connector-side terminal portion 21 and the substrate-side terminal portion 22 is executed to provide secondary machining for the tip portions 21*a* and 22*a* (third step).

Next, the retaining section 23 for engagement in the connector housing is formed (fourth step). Finally, the loss portion 14 is cut off to form the single-unit substrate-use terminal 20 (fifth step). Then, the substrate-use terminals 20 thus cut off are press-fitted in the connector housing, thereby completing the manufacture.

As described above, the loss portion 14 which does not form a portion of the substrate-use terminal 20 after being cut off is provided between adjacent ones of the substrate-use terminals 20 connected in chain form at the time of the shaping of the rectangular wire 10. As a result, it is possible to machine the opposite end portions 21*a* and 22*a* of the connector-side terminal portion 21 and the substrate-side terminal portion 22 of each substrate-use terminal 20 into desired tip shapes, respectively.

Specifically, when the end portions of the substrate-use terminal 20 are subjected to cutting prior to tip crushing, the end portions are cut into such tip profiles that the machined sectional area in tip crushing becomes 35% of the sectional area of the base material, and that the thickness ti of the tip portion 21*a* of the connector-side terminal portion 21 becomes 0.3 mm.

As a result, as shown in FIGS. 3(*a*) and 3(*b*), the substrate-use terminal 20 is obtained in which the thicknesses $t_1$ and $t_2$ of the tips of the connector-side terminal portion 21 and the substrate-side terminal portion 22 assume the same dimension of 0.3 mm, the width $w_1$ of the tip of the connector-side terminal portion 21 is 0.64 mm, and the width $w_2$ of the tip of the substrate-side terminal portion 22 is 0.3 mm. Namely, the substrate-use terminals 20 are obtained in which the thickness ti of the tip of the connector-side terminal portion 21 is 0.3 mm or less, and the machined sectional area of the rectangular wire 10, i.e., the base material, is set to 35% or less of the sectional area of the base material.

As shown in FIGS. 2(*a*) to 2(*d*), for example, the left end portion of the loss portion 14 in the drawings is connected to the tip portion 21*a* of the connector-side terminal portion 21 of one substrate-use terminal 20, and this connecting portion is cut to the required size of the tip portion 21*a*. Then, the loss portion 14 is cut off from the tip portion 21*a*, which has been cut to the required tip shape, at the cut line Li.

In addition, the right end portion of the loss portion 14 in the drawings is connected to the tip portion 22*a* of the substrate-side terminal portion 22 of another substrate-use terminal 20, and this connecting portion is cut to the required size of the tip portion 22*a*. Then, the loss portion 14 is cut off from the tip portion 22*a*, which has been cut to the required tip shape, at the cut line L2. Hence, it is possible to obtain the substrate-use terminals 20 in each of which the connector-side terminal portion 21 machined so as to be provided with the tip portion 21*a* of the required size is formed at one end, while the substrate-side terminal portion 22 machined so as to be provided with the tip portion 22*a* of the required size is formed at the other end.

As described above, in accordance with the method of manufacturing the substrate-use terminals 20 in the above-described embodiment, since the loss portion 14 which does not form a portion of the substrate-use terminal 20 after cutting off is provided between adjacent ones of the substrate-use terminals 20 connected in chain form is formed in the rectangular wire 10 which is formed into the substrate-use terminals 20 after being cut off, the opposite end portions 21*a* and 22*a* of the connector-side terminal portion 21 and the substrate-side terminal portion 22 can be machined into desired different tip shapes, respectively.

As a result, the thickness of the tip of the connector-side terminal portion 21 can be set to 0.3 mm or less, and the machined sectional area of the rectangular wire 10 in the shaping of the connector-side terminal portion 21 and the substrate-side terminal portion 22 can be controlled to 35% or less of the sectional area of the base material. Accordingly, it is possible to reliably prevent a situation in which spring portions of mating female terminals become deformed, or the rectangular wire becomes fractured during the manufacturing process.

As described above, with the method of manufacturing substrate-use terminals in accordance with the present invention, the loss portion which is not used as a portion of the substrate-use terminal after being cut off is provided between units of the rectangular wire which are used as the substrate-use terminals by being cut off, when the rectangular wire is subjected to the shaping, and the respective tip portions of the connector-side terminal portion and the substrate-side terminal portion which are connected to both ends of the loss portion are respectively machined into desired different tip shapes.

Accordingly, since the loss portion is provided, the respective tip portions of the connector-side terminal portion and the substrate-side terminal portion can be subjected to cutting prior to the tip crushing of the substrate-use terminal in the manufacturing process, and the respective tip portions can be machined into desired different tip shapes. Accordingly, the thickness of the tip portion of the connector-side terminal portion can be set to 0.3 mm or less, and the machined sectional area of the rectangular wire, i.e., the base material, can be controlled to 35% or less of the sectional area of the base material. Thus, it is possible to reliably prevent a situation in which spring portions of mating female terminals become deformed, or the rectangular wire becomes fractured during the manufacturing process.

In addition, with the method of manufacturing substrate-use terminals in accordance with the present invention, since the loss portion, which is a connecting portion between the tip portion of the substrate-side terminal portion and the tip portion of the connector-side terminal portion, is provided, the tip portion of the connector-side terminal portion and the tip portion of the substrate-side terminal portion can be subjected to cutting prior to the third step of providing tip crushing.

Accordingly, the respective tip portions of the connector-side terminal portion and the substrate-side terminal portion can be machined into desired different tip shapes, and the thickness of the tip portion of the connector-side terminal portion can be set to 0.3 mm or less, and the machined sectional area of the rectangular wire, i.e., the base material, can be controlled to 35% or less of the sectional area of the base material. Thus, it is possible to reliably prevent a situation in which spring portions of mating female terminals become deformed, or the rectangular wire becomes fractured during the manufacturing process.

What is claimed is:

1. A method of manufacturing substrate-use terminals in which substrate-use terminals each has at one end thereof a connector-side terminal portion for connection to a connector and at another end thereof a substrate-side terminal portion for connection to a substrate, comprising the steps of:

providing a plurality of rectangular wire units connected in series in a longitudinal direction, wherein said rectangular wire units, are used to form said substrate-use terminals;

providing a plurality of loss portions connected in between said rectangular wire units each loss portion having a first end connected to a tip portion of said. connector side-terminal portion and a second end connected to a tip portion of said substrate-side terminal portion;

subjecting said rectangular wire units to a shaping operation; and cutting off said loss portion to form said substrate use terminals after the completion of at least one machining operation.

2. The method of manufacturing substrate-use terminals according to claim 1, wherein respective tip portions of said connector-side terminal portion and said substrate-side terminal portion which are connected to both ends of said loss portion are respectively machined into desired different tip shapes.

3. The method claim of manufacturing substrate-use terminals according to claim 2, wherein said second machining step is used for machining said tip portion of the connector-side terminal portion to a diameter up to 0.3 mm.

4. A method of manufacturing substrate-use terminals in which substrate-use terminals each having at one end thereof a connector side terminal portion for connection to a connector and at another end thereof a substrate-side terminal portion for connection to a substrate are manufactured as a continuous rectangular wire is subjected to shaping and cutting off after the shaping, comprising:

subjecting said rectangular wire to cylindrical-shaping to form said substrate-side terminal portion;

subjecting a loss portion, which serves as a connection portion between a tip portion of said substrate-side terminal portion and a tip portion of said connector-side terminal portion, to cutting so as to provide a first machining step for said tip portions;

performing a second step of machining said tip portions;

forming a retaining section for engagement in a connector housing; and cutting off said loss portion to form a single-unit substrate-use terminal.

5. The method of manufacturing substrate-use terminals according to claim 4, wherein said second machining step is used for machines said tip portion of the substrate-side terminal portion and said tip portion of the connector side terminal portion into different shapes.

6. The method claim of manufacturing substrate-use terminals according to claim 5, wherein said second machining step is used for machining said tip portion of the connector-side terminal portion to a diameter up to 0.3 mm.

* * * * *